US008202068B2

(12) United States Patent
Kiem et al.

(10) Patent No.: US 8,202,068 B2
(45) Date of Patent: Jun. 19, 2012

(54) CAPACITY VARYING DEVICE FOR SCROLL COMPRESSOR

(75) Inventors: Myung-Kyun Kiem, Seoul (KR); Seong-Weong Hwang, Seoul (KR)

(73) Assignee: LG Electronics Inc., Seoul (KR)

( * ) Notice: Subject to any disclaimer, the term of this patent is extended or adjusted under 35 U.S.C. 154(b) by 644 days.

(21) Appl. No.: 12/372,986

(22) Filed: Feb. 18, 2009

(65) Prior Publication Data

US 2009/0208348 A1 Aug. 20, 2009

(30) Foreign Application Priority Data

Feb. 19, 2008 (KR) ..... 10-2008-0015047

(51) Int. Cl.
*F04B 17/00* (2006.01)

(52) U.S. Cl. ..... 417/410.5; 417/213; 417/310

(58) Field of Classification Search ..... 417/213, 417/310, 410.5
See application file for complete search history.

(56) References Cited

U.S. PATENT DOCUMENTS 4,892,469 A * 1/1990 McCullough et al. ..... 418/55.5
5,547,344 A * 8/1996 Sugiyama et al. ..... 417/32
5,551,846 A 9/1996 Taylor et al.
6,116,867 A 9/2000 Wallis et al.
6,120,255 A 9/2000 Schumann et al.
6,619,062 B1 * 9/2003 Shibamoto et al. ..... 62/228.3
2002/0114720 A1 * 8/2002 Itoh et al. ..... 418/55.2
2008/0286118 A1 * 11/2008 Gu et al. ..... 417/1
2011/0135509 A1 * 6/2011 Fields et al. ..... 417/310

FOREIGN PATENT DOCUMENTS

JP 08-318276 12/1996
JP 2000356194 A * 12/2000
JP 2002-81566 3/2002
KR 10-2005-0095246 9/2005
KR 10-2007-0027313 3/2007

OTHER PUBLICATIONS

Korean Office Action dated Jul. 28, 2009.
Chinese Office Action dated Jul. 30, 20120 (Application No. 200910008201.5).

* cited by examiner

*Primary Examiner* — Peter Macchiarolo
(74) *Attorney, Agent, or Firm* — KED & Associates, LLP

(57) ABSTRACT

A capacity varying device for a scroll compressor may include a fixed scroll and an orbiting scroll both located in a casing, a low pressure passage formed by an orbiting motion of the orbiting scroll that communicates with a suction side, an intermediate pressure passage formed by the orbiting motion of the orbiting scroll that communicates with an intermediate pressure side, a rotating device rotatably coupled to the fixed scroll and having a connection passage therein, and an operating device mounted at the fixed scroll and configured to rotate the rotating device such that the low pressure passage and the intermediate pressure passage are connected to each other or disconnected from each other via the connection passage of the rotating device. Accordingly, a capacity for compressing gas may be varied, a size of the device may be reduced due to a compact configuration and structure for varying the capacity, and also a fast response to the varying of the capacity may be provided.

9 Claims, 14 Drawing Sheets

FIG.1-A
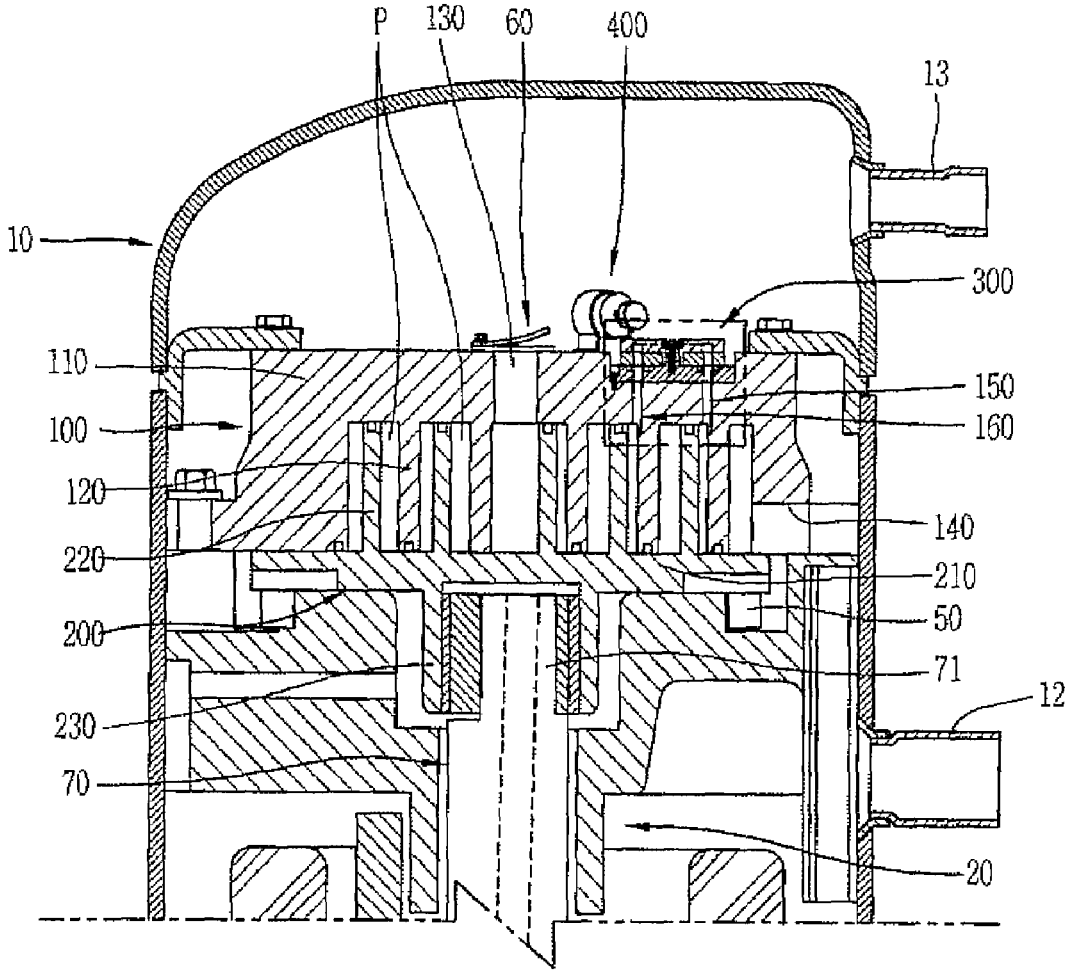

FIG.1-B
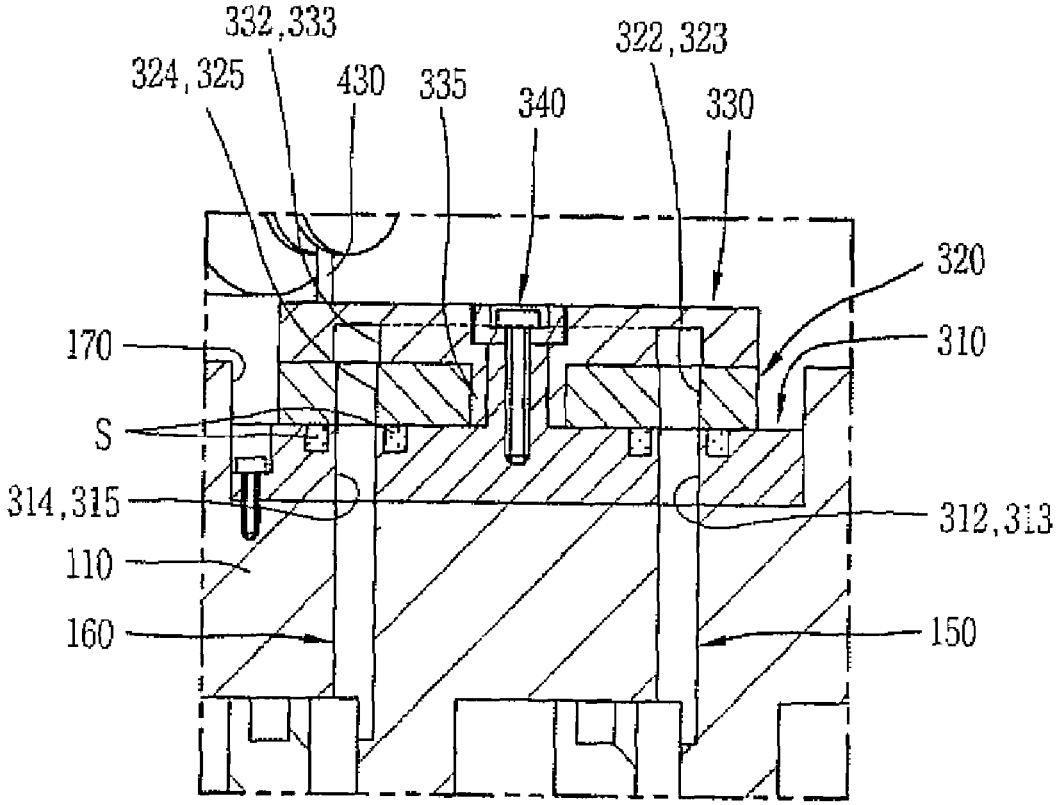

CAPACITY VARYING DEVICE FOR SCROLL COMPRESSOR

The present application claims priority to Korean Application No. 10-2008-0015047, filed in Korea on Feb. 19, 2008, which is herein expressly incorporated by reference in its entirety.

BACKGROUND

1. Field

A scroll compressor, and more particularly, a capacity varying device for a scroll compressor are disclosed herein.

2. Background

Scroll compressors are known. However, they suffer from various disadvantages.

BRIEF DESCRIPTION OF THE DRAWINGS

Embodiments will be described in detail with reference to the following drawings in which like reference numerals refer to like elements, and wherein:

FIGS. 1A-1B are front views of a compression part of a scroll compressor having a capacity varying device for a scroll compressor in accordance with an embodiment;

DETAILED DESCRIPTION

Figure 2:
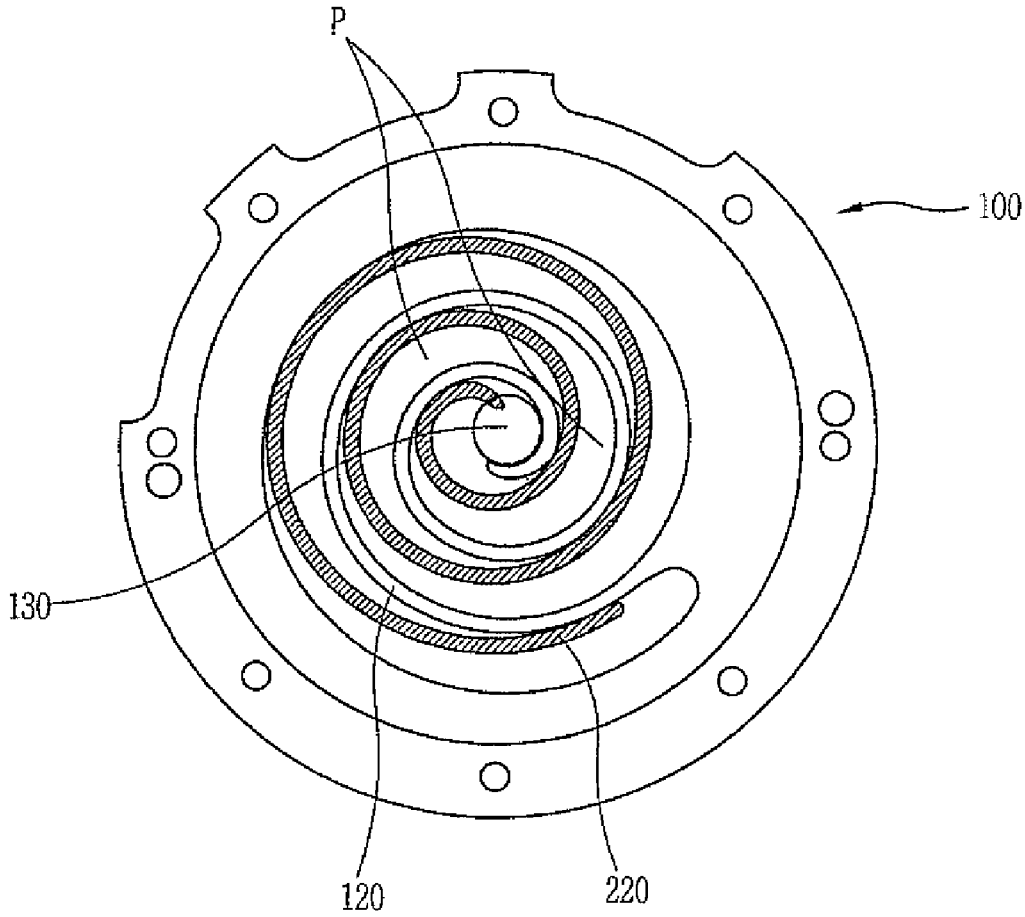
FIG. 2 is a plane view of a fixed scroll wrap and an orbiting scroll wrap of the compression part of the scroll compressor of FIGS. 1A-1B.

Description will now be given in detail of a capacity varying device for a scroll compressor in accordance with an embodiment, with reference to the accompanying drawings. Where possible, like reference numerals have been used to indicate like elements.

In general, compressors convert electrical energy into kinetic energy and compress a refrigerant gas using the kinetic energy. The compressors may be classified into, for example, a rotary compressor, a scroll compressor, or a reciprocal compressor, depending on the mechanism used for compression. If a refrigerant gas is to be compressed, the compressor may serve as an essential component of a refrigerating cycle system. Such a refrigerating cycle system may be used for, for example, refrigerators, air conditioners, showcases, or similar devices.

In general, a scroll compressor may be classified as a high pressure type or a low pressure type, according to an internal pressure of a casing in which a plurality of components is installed. Alternatively, the scroll compressor may be classified as a symmetrical scroll compressor or a non-symmetrical scroll compressor, according to an internal pressure of a plurality of compression pockets. Also, the scroll compressor may be configured such that a suction gas is sucked into each of the plurality of compression pockets and moved toward a central portion of a scroll. If gas suction volumes of the compression pockets are the same, the scroll compressor is a symmetrical scroll compressor, and if not, the scroll compressor is a non-symmetrical compressor.

The scroll compressor typically serves as a component of the refrigerating cycle system. One example of a refrigerating cycle system having a scroll compressor is an air conditioner.

In order to minimize power consumption of an air conditioner, a capacity of a scroll compressor by which a refrigerating cycle system is driven must be varied. That is, when a large load is applied to the air conditioner, the air conditioner is driven in a power mode in which an amount of discharge gas flowing in the scroll compressor is increased. On the other hand, when a smaller load is applied, the air conditioner is driven in a saving mode in which the amount of discharge gas flowing in the scroll compressor is decreased.

Methods for varying the capacity of the scroll compressor may include an inverter related method and a bypass related method. The inverter related method varies a rotational speed of a motor; however, control is complicated and components expensive. The bypass related method uses a constant speed motor to enable communication between a high pressure side and a low pressure side; however, although the cost is relatively low, the fabrication is complicated and a size of the compressor increases.

Figure 3:
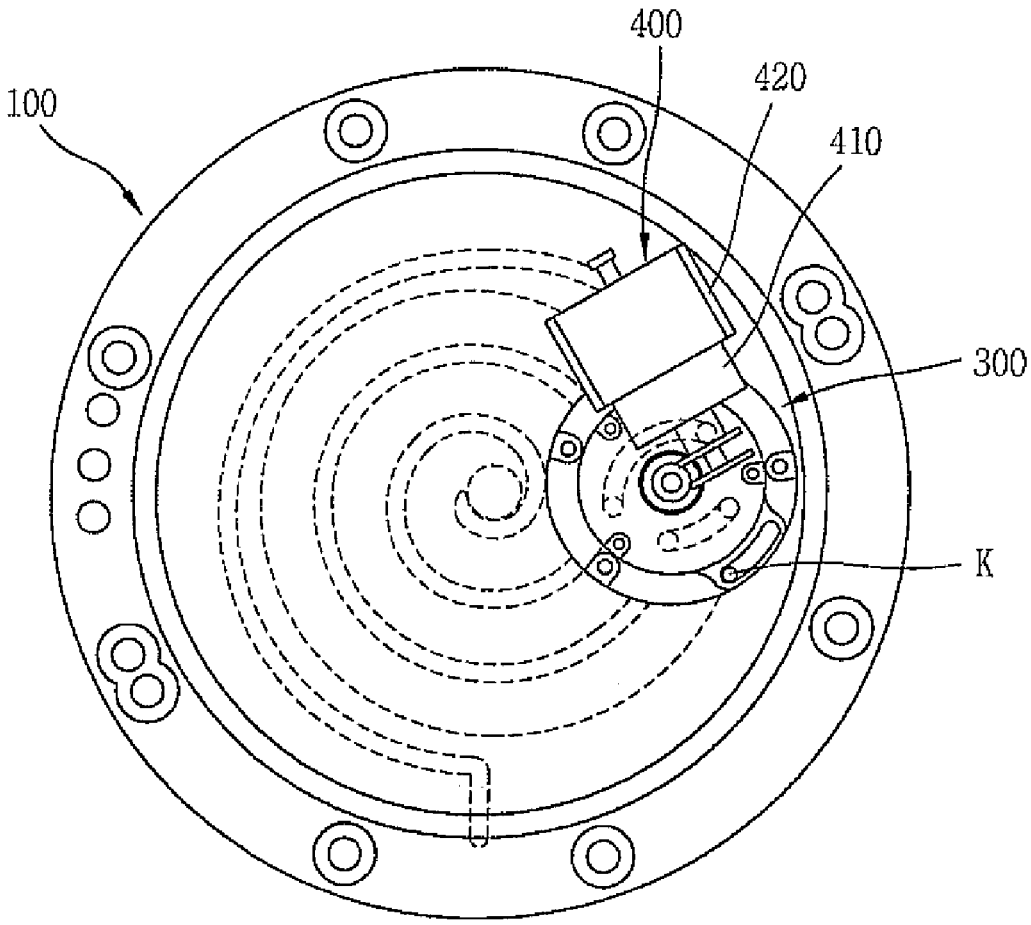
FIG. 3 is a plane view of a compression part of a scroll compressor having a capacity varying device in accordance with an embodiment.
Figure 4:
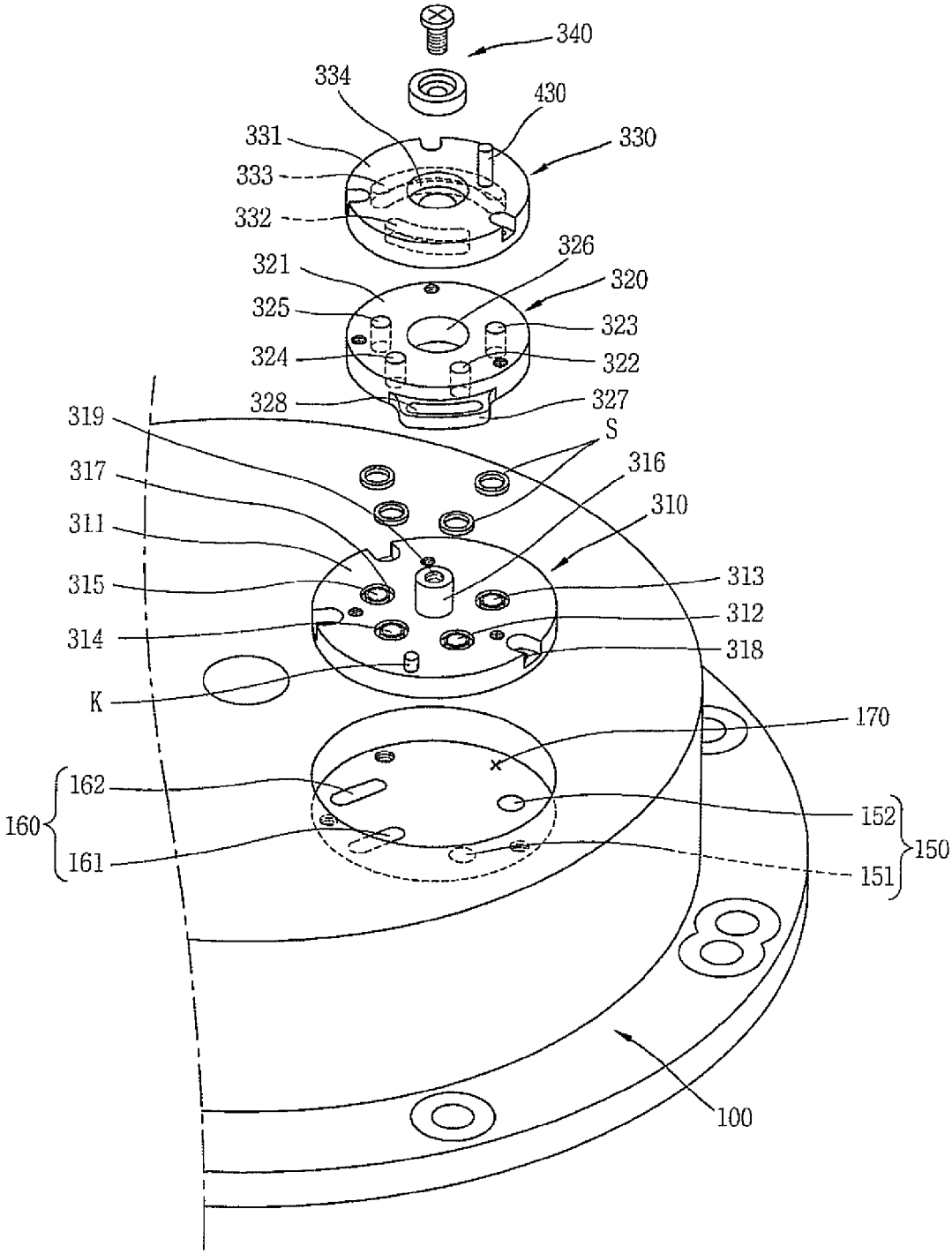
FIG. 4 is a disassembled view of a capacity varying device for a scroll compressor in accordance with an embodiment.
Figure 5:
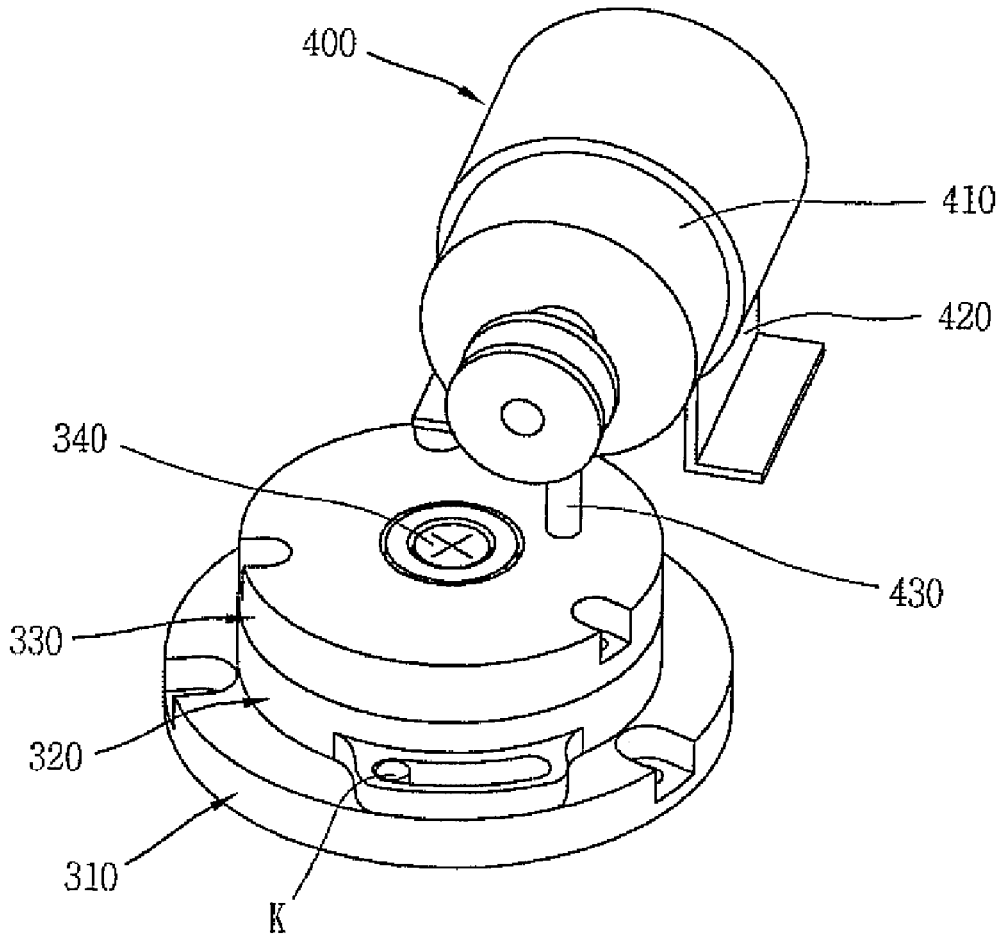
FIG. 5 is a perspective view showing an assembled state of the capacity varying device of FIG. 4.

FIGS. 1A-1B are front views showing a compression part of a scroll compressor having a capacity varying device for a scroll compressor in accordance with an embodiment. FIG. 2 is a plane view of a fixed scroll wrap and an orbiting scroll wrap of the compression part of the scroll compressor of FIG. 1. FIG. 3 is a plane view of a compression part of a scroll compressor having a capacity varying apparatus in accordance with an embodiment. FIG. 4 is a disassembled view of a capacity varying device for a scroll compressor in accordance with an embodiment. FIG. 5 is a perspective view showing an assembled state of the capacity varying device of FIG. 4.

A compression part of a scroll compressor will now be described with reference to FIGS. 1A to 4.

A fixed scroll 100 having a particular shape may be mounted in a casing 10, with a specific gap from an upper frame 20, also mounted in the casing 10. Further, an orbiting scroll 200 may be located between the fixed scroll 100 and the upper frame 20 to be orbitingly engaged with the fixed scroll 100.

The fixed scroll 100 may include wraps 120 having a shape of an involute curve with a particular thickness and height formed at one surface of a body portion 110. A discharge hole 130 may be formed in a center of the body portion 110. Also, an inlet 140 may be formed at one side of the body portion 110.

The orbiting scroll 200 may include wraps 220 having a shape of an involute curve with a particular thickness and height formed at one surface of a circular plate portion 210 with a particular thickness and area. A boss portion 230 may be formed at another surface of the circular plate portion 210.

The wraps 220 of the orbiting scroll 200 may be inserted between the upper frame 20 and the fixed scroll 100 so as to be engaged with the wraps 120 of the fixed scroll 100. When the orbiting scroll 200 orbits, a plurality of compression pockets P may be consecutively generated by the wraps 220 of the orbiting scroll 200 and the wraps 120 of the fixed scroll 100. The compression pockets P located at an edge of the fixed scroll 100 may be under a low suction pressure atmosphere, the compression pockets P located at a center of the fixed scroll 100 may be under a high discharge pressure atmosphere, and the compression pockets P located between the edge and the center of the fixed scroll 100 may be under an intermediate pressure atmosphere. The orbiting scroll 200 may be supported at an upper surface of the upper frame 20.

An Oldham ring 50 that prevents the orbiting scroll 200 from rotating on its axis may be coupled between the orbiting scroll 200 and the upper frame 20. A discharge valve assembly 60 that opens/closes the discharge hole 130 of the fixed scroll 100 may be disposed at an upper surface of the fixed scroll 100. A boss portion 230 of the orbiting scroll 200 may be connected to an eccentric portion 71 of a rotational shaft 70 inserted in the upper frame 20.

As shown in FIG. 1B, a suction pipe 12 through which gas may be sucked into the compressor may be penetratingly coupled to the casing 10, and a discharge pipe 13 through which gas may be discharged may be coupled to the casing 10. The compression part may be a compression part for a non-symmetrical compressor.

A low pressure passage 150 that communicates with a suction side formed by the orbiting motion of the orbiting scroll 200, and an intermediate pressure passage 160 that communicates with an intermediate pressure side formed by the orbiting motion of the orbiting scroll 200 may be provided. As shown in FIG. 4, the low pressure passage 150 and the intermediate pressure passage 160 may be respectively formed in the body portion 110 of the fixed scroll 100. Further, the low pressure passage 150 and the intermediate pressure passage 160 may be longitudinally formed through the body portion 110 of the fixed scroll 100.

The low pressure passage 150 may include first and second holes 151 and 152 located with a gap therebetween, and the intermediate pressure passage 160 may include first and second holes 161 and 162 located with a gap therebetween. As shown in FIG. 4, the first and second holes 151 and 152 may be circular, and the first and second holes 161 and 162 may be elongated openings. The low pressure passage 150 may be located a predetermined distance from a middle of the body portion 110 of the fixed scroll 100 toward an edge thereof, in comparison to the intermediate pressure passage 160.

A rotating device 300 may be rotatably coupled to an upper surface of the fixed scroll 100. A connection passage disposed in the rotating device 300 may connect the low pressure passage 150 to the intermediate pressure passage 160, and may disconnect the low pressure passage 150 from the intermediate passage 160, in cooperation with the rotation of the rotating device 300.

The rotating device 300 may include a first disc 310 coupled to the upper surface of the fixed scroll 100, a second disc 320 rotatably coupled to the first disc 310, a third disc 330 fixed to the second disc 320, and a separation preventing member 340 coupled to the first disc 310 that prevents separation of the second and third discs 320 and 330. The first disc 310 may include a circular body 311 having a particular thickness and external diameter, first and second low pressure communicating holes 312 and 313 each formed through the circular body 311 that communicate with the low pressure passage 150, first and second intermediate pressure communicating holes 314 and 315 each formed through the circular body 311 that communicate with the intermediate pressure passage 160, and a reference shaft 316 that extends from a center of the circular body 311 by a particular height.

An annular groove 317 having a particular width and depth may be formed on an upper surface of the circular body 311 of the first disc 310 at a circumference of each communicating hole. A sealing member S may be inserted in each annular groove 317. Further, a plurality of coupling portions 318 may be provided at an edge of the circular body 311 of the first disc 310.

An installation groove 170 having a particular depth and internal diameter may be formed in an upper surface of the fixed scroll 100. The first disc 310 may be inserted in the installation groove 170 and coupled to the upper surface of the fixed scroll 100. The internal diameter of the installation groove 170 may correspond to an external diameter of the first disc 310. Bolts (not shown) may be inserted in each coupling portion 318 of the first disc 310 to couple the first disc 310 to the fixed scroll 100.

The low pressure passage 150 and the intermediate pressure passage 160 may be located at a lower surface of the installation groove 170. When the first disc 310 is disposed in the installation groove 170 to be fixed thereto, the first and second low pressure communicating holes 312 and 313 of the first disc 310 may communicate with the low pressure passage 150, and the first and second intermediate pressure communicating holes 314 and 315 may communicate with the intermediate pressure passage 160.

The second disc 320 may include a circular body 321 having a particular thickness and external diameter, first and second low pressure communicating holes 322 and 323 formed to correspond to the first and second low pressure communicating holes 312 and 313 of the first disc 310, first and second intermediate pressure communicating holes 324 and 325 formed to correspond to the first and second intermediate pressure communicating holes 314 and 315 of the first disc 310, and an insertion hole 326 formed through a center of the circular body 321. The second disc 320 may be rotatably coupled to the first disc 310. That is, the reference shaft 316 of the first disc 310 may be inserted into the insertion hole 326 of the second disc 320.

The third disc 330 may include a circular body 331 having a particular thickness and external diameter, a first connection groove 332 formed in a lower surface of the circular body 331 that allows the first low pressure communicating hole 322 of the second disc 320 to be connected to the first intermediate pressure communicating hole 324, a second connection groove 333 formed in the lower surface of the circular body 331 that allows the second low pressure communicating hole 323 of the second disc 320 to be connected to the second intermediate pressure communicating hole 325, and an insertion hole 334 formed through a center of the circular body 331. Each of the first and second connection grooves 332 and 333 may be formed in an arcuate shape having a particular width and length, and a length of the first connection groove 330 may be shorter than that of the second connection groove 333.

As shown in FIG. 1B, a boss portion 335 having a particular external diameter and length may be formed at a lower surface of the circular body 331 of the third disc 330, and the insertion hole 334 may be formed in a center of the boss portion 335.

The external diameter of the boss portion 335 may correspond to an internal diameter of the insertion hole 326 of the second disc 320, and a length of the boss portion 335 may be equal to or shorter than a thickness of the second disc 320.

A plurality of coupling portions 336 may be disposed at an edge of the circular body 331 of the third disc 330. An external diameter of the third disc 330 may be the same to that of the second disc 320.

The third disc 330 may be fixedly coupled to the second disc 320. That is, the reference shaft 316 of the first disc 310 may be inserted in the insertion hole 334 of the third disc 330, and the boss portion 335 of the third disc 330 may be inserted in the insertion hole 326 of the second disc 320. Thus, the lower surface of the circular body 331 of the third disc 330 may contact an upper surface of the second disc 320. The first connection groove 332 of the third disc 330 allows the first low pressure communicating hole 322 of the second disc 320 to be connected to the first intermediate pressure communicating hole 324 of the second disc 320, and the second connection groove 333 allows the second low pressure communicating hole 323 of the second disc 320 to be connected to the second intermediate pressure communicating hole 325 of the second disc 320. In this state, bolts (not shown) may be inserted in each coupling portion 336 of the third disc 330 to couple the third disc 330 to the second disc 320.

The depth of the installation groove 170 formed in the upper surface of the fixed scroll 100 may be the same as a sum of the thicknesses of the first disc 310 and the second disc 320. The separation preventing member 340 may be in the form of a bolt 340*a*, and a screw opening 319 may be formed in the center of the reference shaft 316. Accordingly, separation preventing member 340 in the form of the bolt 340*a* may be coupled to the screw opening 319 of the reference shaft 316. A lower surface of the bolt head may contact and be supported by a stepped surface 337 extending from an inner wall of the insertion hole 334 of the third disc 330, to prevent the separation of the second and third discs 320 and 330.

A stopper may be provided at the first and second disc 310 and 320 to restrict the moving of the second disc 320. The stopper may include an extending portion 327 that extends from an outer circumferential surface of the second disc 320 with a particular area and having an opening 328 formed therethrough, and a fixing pin K fixedly coupled to the first disc 310 and positioned inside the opening 328, to restrict the rotation of the second disc 320. An external diameter of the fixing pin K may be shorter than a width of the opening 328.

Figure 7:
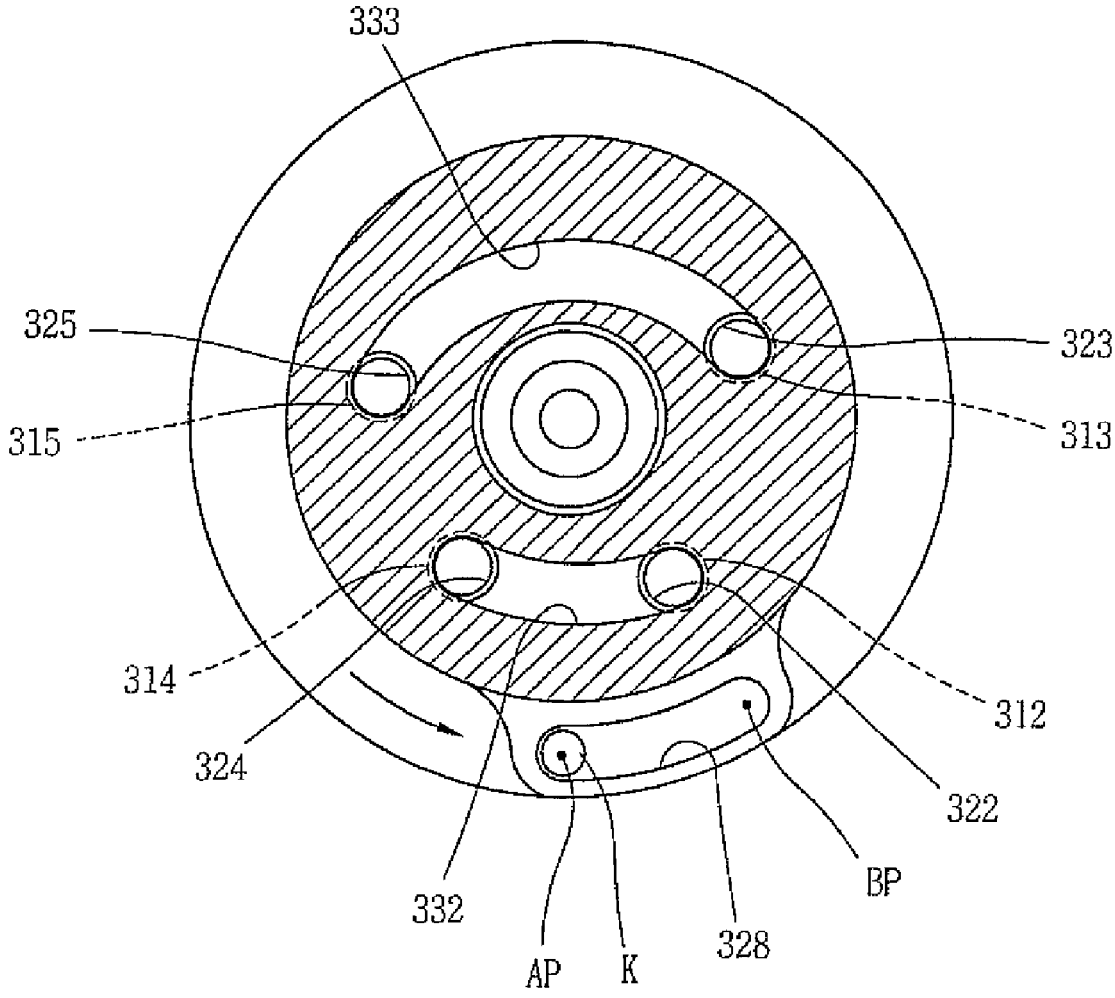
FIG. 7 is a plane view showing another state of a capacity varying device for a scroll compressor during its operation in accordance with an embodiment.

Referring to FIG. 7, assuming that one side end of the opening 328 is AP and another side end is BP, when the fixing pin K is located at AP, the first and second low pressure communicating holes 312 and 313 of the first disc 310, respectively, communicate with the first and second low pressure communicating holes 322 and 323 of the second disc 320, and also the first and second intermediate pressure communicating holes 314 and 315 of the first disc 310, respectively, communicate with the first and second intermediate pressure communicating holes 324 and 325 of the second disc 320. When the fixing pin K is located at BP, the first and second low pressure communicating holes 312 and 313 of the first disc 310 do not communicate with the first and second low pressure communicating holes 322 and 323 of the second disc 320, and also the first and second intermediate pressure communicating holes 314 and 315 of the first disc 310 do not communicate with the first and second intermediate pressure communicating holes 324 and 325 of the second disc 320.

An operating device 400 that angularly rotates the rotating device 300 may be mounted at the fixed scroll 100. The operating device 400 may include a solenoid 410 that generates a linear reciprocating force, a fixing member 420 coupled to the fixed scroll 100 to fix and support the solenoid 410, and a connection pin 430 coupled to the rotating device 300 and connected to the solenoid 410. The solenoid 410 may be a solenoid that maintains magnetism, including a magnet to generate a linear reciprocating force by power and magnetic force. Two plates may be coupled to a shaft of the solenoid 410 with a certain interval therebetween, and the connection pin 430 may be located between the two plates. The operating device 400 may operate to push or pull the connection pin 430, and accordingly, the second disc 320 and the third disc 330 may be rotated centering around the reference shaft 316.

Hereinafter, an operation of a capacity varying device for a scroll compressor in accordance with an embodiment will be described herein below, starting with the operation of the compression part of the scroll compressor.

When a rotational force of a motor part is transferred to the orbiting scroll 200 via the rotational shaft 70, the orbiting scroll 200 may orbit centering around the center of the rotational shaft 70 while engaged with the fixed scroll 100. In cooperation with the orbiting motion of the orbiting scroll 200, the wraps 220 of the orbiting scroll 200 orbit while engaged with the wraps 120 of the fixed scroll 100. Accordingly, a plurality of compression pockets P may be formed by the wraps 220 of the orbiting scroll 200 and the wraps 120 of the fixed scroll 100 and move toward the center of the fixed scroll 100.

As the plurality of compression pockets P move toward the center, a volume may change to suck and compress gas. Such compressed gas may then discharged via the discharge hole 130 of the fixed scroll 100. The plurality of compression pockets P may be continuously formed at the edge of the fixed scroll 100 and the orbiting scroll 200. While such compression pockets P move toward the center, gas may be compressed. Gas sucked via the suction pipe 12 may be introduced in the compression pockets P via the inlet 140.

When the compression pockets P are located at the edge of the fixed scroll 100, this state is a low suction pressure state. When the compression pockets P are located at the center of the fixed scroll 100, this state is a high discharge pressure state. When the compression pockets P are located between the center and the edge of the fixed scroll 100, this state is an intermediate pressure state.

Gas in a high temperature, high pressure state discharged via the discharge hole 130 of the fixed scroll 100 may be then discharged to the exterior of the casing 10 via the discharge pipe 13.

Figure 6:
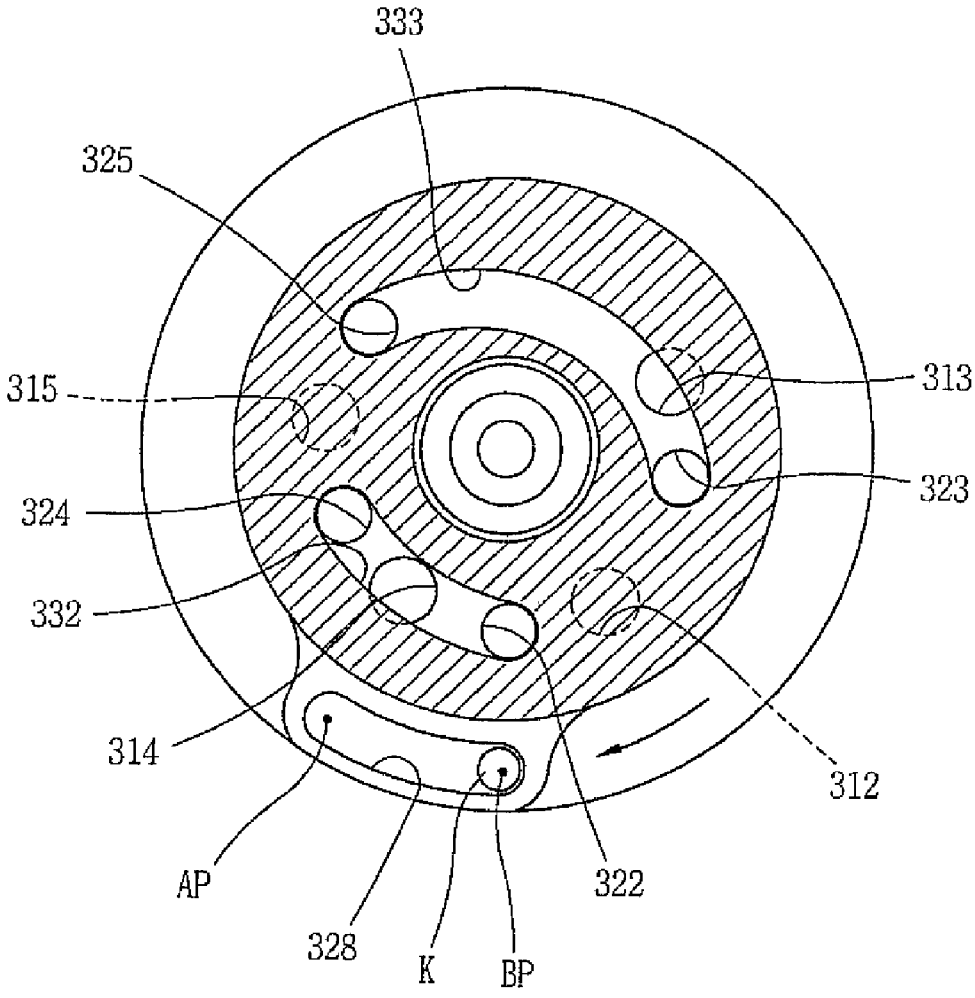
FIG. 6 is a plane view showing one state of a capacity varying device for a scroll compressor during its operation in accordance with an embodiment.

In the meantime, when the scroll compressor is driven with 100% of capacity (hereinafter, referred to as a "power mode"), as shown in FIG. 6, the solenoid 410 of the operating device 400 is in the state of pulling the connection pin 430. Since the connection pin 430 is in the pulled state, the first and second low pressure communicating holes 312 and 313 of the first disc 310 do not communicate with the first and second low pressure communicating holes 322 and 323 of the second disc 320, and additionally, the first and second intermediate pressure communicating holes 314 and 315 of the first disc 310 do not communicate with the first and second intermediate pressure communicating holes 324 and 325 of the second disc 320.

Accordingly, since the low pressure passage 150 does not communicate with the intermediate pressure passage 160, the compression pocket P located at the suction side is not connected to the compression pocket P located at the intermediate pressure side, and accordingly, as mentioned above, the compression pockets P located at the edge of the fixed scroll 100 move toward the center of the fixed scroll 100, such that gas sucked into the compression pockets P at the edge may be compressed and then discharged.

If the scroll compressor is driven with a reduced compression capacity (hereinafter, referred to as a "saving mode"), as shown in FIG. 7, when the solenoid 410 operates to push the connection pin 430, the second and third discs 320 and 330 rotate, such that the first and second low pressure communicating holes 312 and 313 of the first disc 310 communicate with the first and second low pressure communicating holes 322 and 323 of the second disc 320, and also the first and second intermediate pressure communicating holes 314 and 315 of the first disc 310 communicate with the first and second intermediate pressure communicating holes 324 and 325 of the second disc 320.

Accordingly, the first low pressure communicating hole 312 of the first disc 310, the first low pressure communicating hole 322 of the second disc 320, the first connection groove 332 of the third disc 330, the first intermediate pressure communicating hole 324 of the second disc 320, and the first intermediate pressure communicating hole 314 of the first disc 310 may all be connected together. Simultaneously, the second low pressure communicating hole 313 of the first disc 310, the second low pressure communicating hole 323 of the second disc 320, the second connection groove 333 of the third disc 330, the second intermediate pressure communicating hole 325 of the second disc 320 and the second intermediate pressure communicating hole 315 of the first disc 310 may all be connected. Hence, the low pressure passage 150 and the intermediate pressure passage 160 may communicate with each other, such that the compression pocket P in the intermediate pressure state may communicate with the compression pocket P in the suction pressure state.

When operated in such state, the compression pocket P in the intermediate pressure state communicates with the compression pocket P in the suction pressure state, by which the compression pocket P in the intermediate pressure state may be converted into a low suction pressure state. Accordingly, a volume may be decreased while the compression pocket P is moved from the intermediate pressure position to the discharge hole 130 of the fixed scroll 100, to compress gas. The compressed gas may then be discharged through the discharge hole 130 of the fixed scroll 100. Therefore, the gas pressure discharged via the discharge hole 130 may be lowered and additionally the capacity may be reduced.

As the connection pin 430 is pulled and pushed in cooperation with the operation of the solenoid 410, when the second and third discs 320 and 330 rotate, their rotation may be restricted by the fixing pin K coupled to the first disc 310. Where the solenoid 410 is configured as a solenoid that maintains magnetism, upon the pulling or pushing operation, its state is maintained by the magnet configuring the solenoid for maintaining magnetism.

Hereinafter, another embodiment of a capacity varying device for a scroll compressor according to an embodiment will be described in detail with reference to FIGS. 8 and 9. This embodiment is the same as the previously discussed embodiment except for the rotating device, and thus, repetitive disclosure will be omitted.

Figure 8:
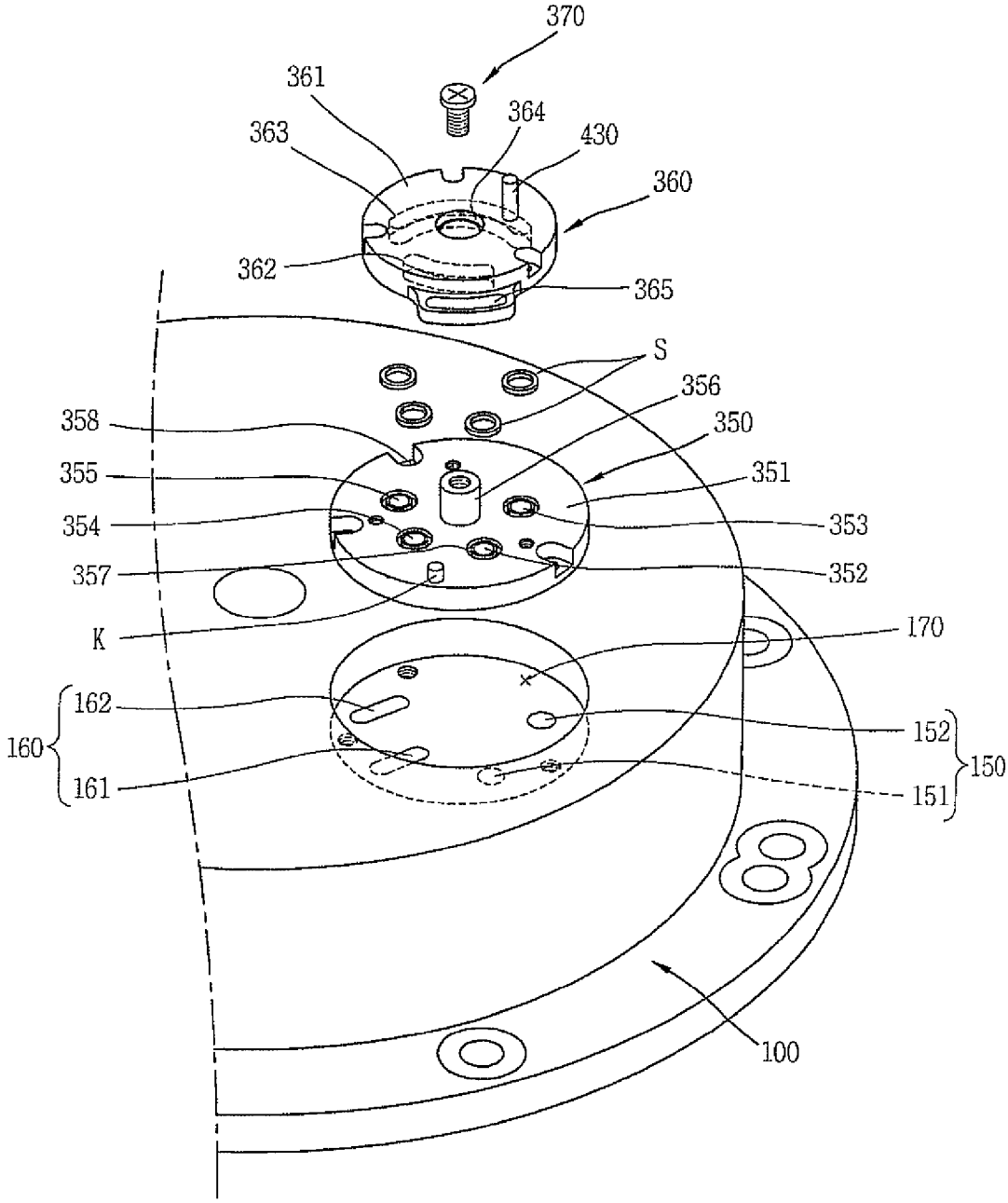
FIG. 8 is a perspective view showing a disassembled state of a capacity varying device for a scroll compressor in accordance with another embodiment.
Figure 9:
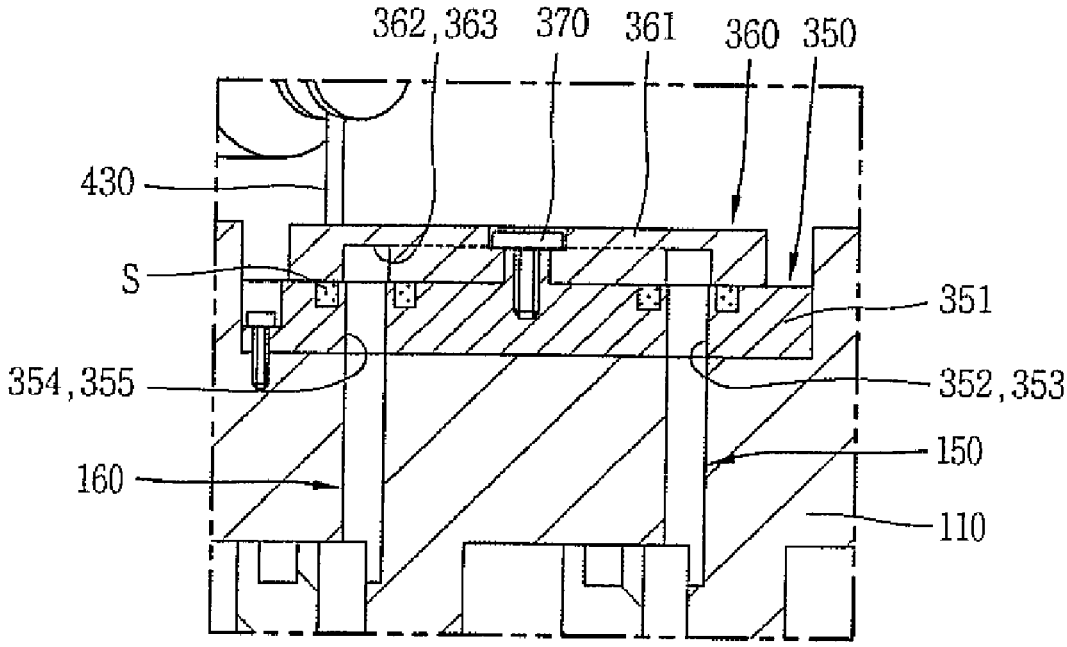
FIG. 9 is a cross-sectional view showing an assembled state of the capacity varying device of FIG. 8.

As shown in FIGS. 8 and 9, a capacity varying device for a scroll compressor according to another embodiment may include a fixed scroll 100 and an orbiting scroll 200 both located inside a casing 10, a low pressure passage 150 formed by an orbiting motion of the orbiting scroll 200 to thusly communicate with a suction side, an intermediate pressure passage 160 formed by the orbiting motion of the orbiting scroll 200 to thusly communicate with an intermediate pressure side, a rotating device 300 rotatably coupled to the fixed scroll 100 and having a connection passage therein, and an operating device 400 mounted at the fixed scroll 100 and configured to rotate the rotating device 300 such that the connection passage of the rotating device 300 may connect the low pressure passage 150 to the intermediate pressure passage 160, and may disconnect the low pressure passage 150 from the intermediate pressure passage 160.

The rotating device 300 of this embodiment may include a first disc 350 coupled to an upper surface of the fixed scroll 100, a second disc 360 rotatably coupled to the first disc 350, and a separation preventing member 370 coupled to the first disc 350 to prevent the separation of the second disc 360. The first disc 350 may include a circular body 351 having a particular thickness and external diameter, first and second low pressure communicating holes 352 and 353 formed through the circular body 351 to communicate with the low pressure passage 150, first and second intermediate pressure communicating holes 354 and 355 formed through the circular body 351 to communicate with the intermediate pressure passage 160, and a reference shaft 356 that extends from a center on an upper surface of the circular body 351 by a certain height.

An annular groove 357 with a particular width and depth may be formed in an upper surface of the circular body 351 of the first disc 350 at a circumference of each communicating hole, and a sealing member S may be inserted in each annular groove 357. A plurality of coupling portions 358 may be provided at an edge of the circular body 351 of the first disc 350.

An installation groove 170 having a particular depth and internal diameter may be formed in the upper surface of the fixed scroll 100. The first disc 350 may be inserted in the installation groove 170 to be coupled thereto. An internal diameter of the installation groove 170 may correspond to an external diameter of the first disc 350. Bolts (not shown) may be inserted in each coupling portion 358 of the first disc 350 to be coupled to the fixed scroll 100, thereby fixing the first disc 350 to the fixed scroll 100.

The low pressure passage 150 and the intermediate pressure passage 160 may be located at a lower surface of the installation groove 170 of the fixed scroll 100. When the first disc 350 is disposed in the installation groove 170 to be fixed thereto, the first and second low pressure communicating holes 352 and 353 of the first disc 350 may communicate with the low pressure passage 150, and the first and second intermediate pressure communicating holes 354 and 355 of the fourth disc 350 may communicate with the intermediate pressure passage 160.

The second disc 360 may include a circular body 361 having a particular thickness and external diameter, a first connection groove 362 formed in a lower surface of the circular body 361 and allowing the first low pressure communicating hole 352 of the first disc 350 to be connected to the first intermediate pressure communicating hole 354 of the first disc 350, a second connection groove 363 formed in the lower surface of the circular body 361 and allowing the second low pressure communicating hole 353 of the first disc 350 to be connected to the second intermediate pressure communicating hole 355 of the first disc 350, and an insertion hole 364 formed through a center of the circular body 361. Each of the first and second connection grooves 362 and 363 may be formed in an arcuate shape having a particular width and length, and the length of the first connection groove 362 may be shorter than that of the second connection groove 363. Further, the external diameter of the first disc 350 may be greater than that of the second disc 360.

The second disc 360 may be rotatably coupled to the first disc 350. That is, the reference shaft 356 of the first disc 350 may be inserted in the insertion hole 364 of the second disc 360, so that the lower surface of the second disc 360 comes in contact with the upper surface of the first disc 350.

The separation preventing member 360 may be configured as a bolt. Such a bolt may be coupled to the reference shaft 356 of the first disc 350, such that the separation of the second disc 360 may be prevented by the bolt head.

An operating device 400 may be connected to the second disc 360. A fixing pin K may be coupled to the first disc 350. An opening 365 may be formed in the second disc 360, and the fixing pin K may be located in the opening 365.

Hereinafter, operation of a capacity varying device for a scroll compressor in accordance with another embodiment will be described hereinafter. The basic operations of this embodiment is similar to the previously discussed embodiment. However, in this embodiment, while the second disc 360 moves within a preset range in cooperation with the operation of the operating device 400, the first and second connection grooves 362 and 363 of the fifth disc 360 allow connection between the first low pressure communicating hole 352 and the first intermediate pressure communicating hole 354 of the first disc 350 and disconnection of the first low pressure communicating hole 352 from the first intermediate pressure communicating hole 354 of the first disc 350, and additionally, connection between the second low pressure communicating hole 353 and the second intermediate pressure communicating hole 355 of the first disc 350 and disconnection of the second low pressure communicating hole 353 from the second intermediate pressure communicating hole 355 of the first disc 350.

Accordingly, the low pressure passage 150 and the intermediate pressure passage 160 of the fixed scroll 100 may communicate with each other or may be disconnected, to vary a compression capacity.

Figure 10:
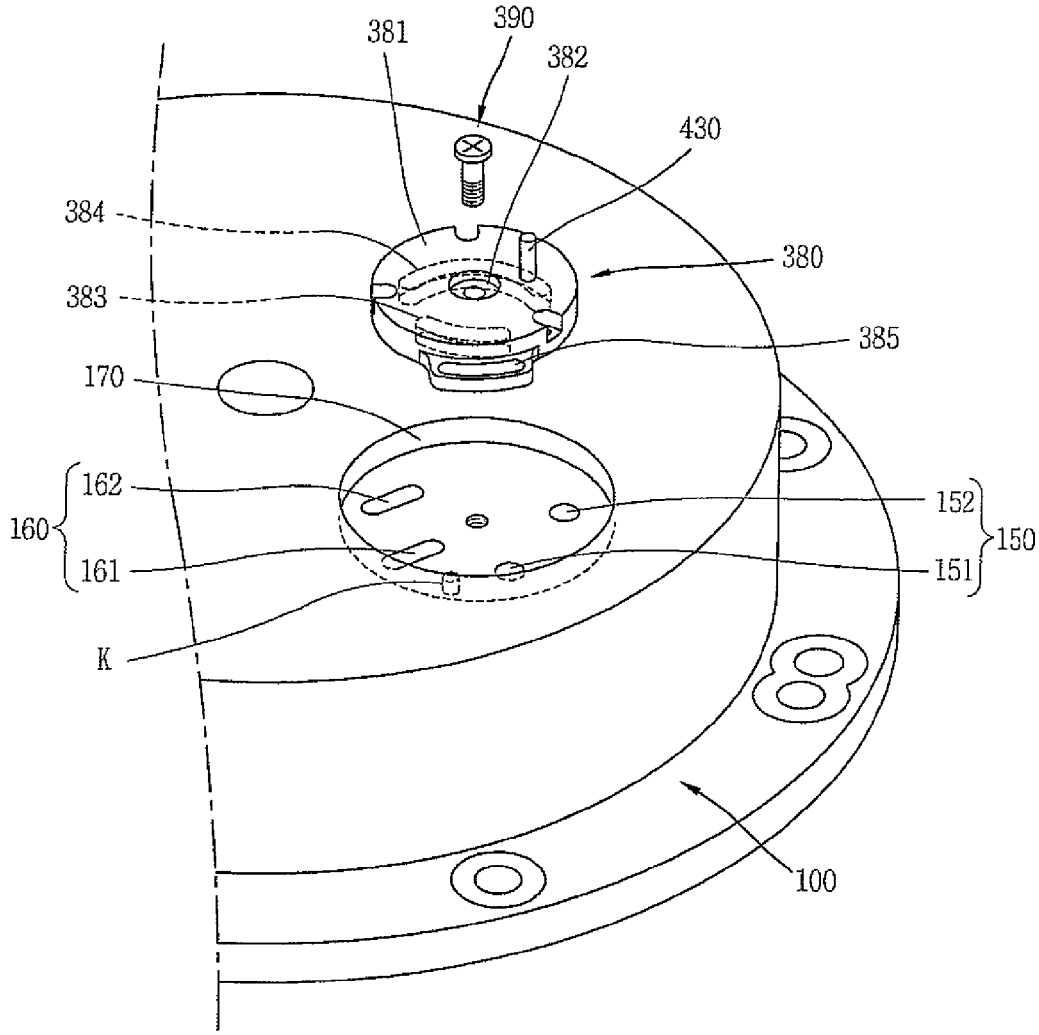
FIG. 10 is a perspective view showing a disassembled state of a capacity varying device for a scroll compressor in accordance with still another embodiment.
Figure 11:
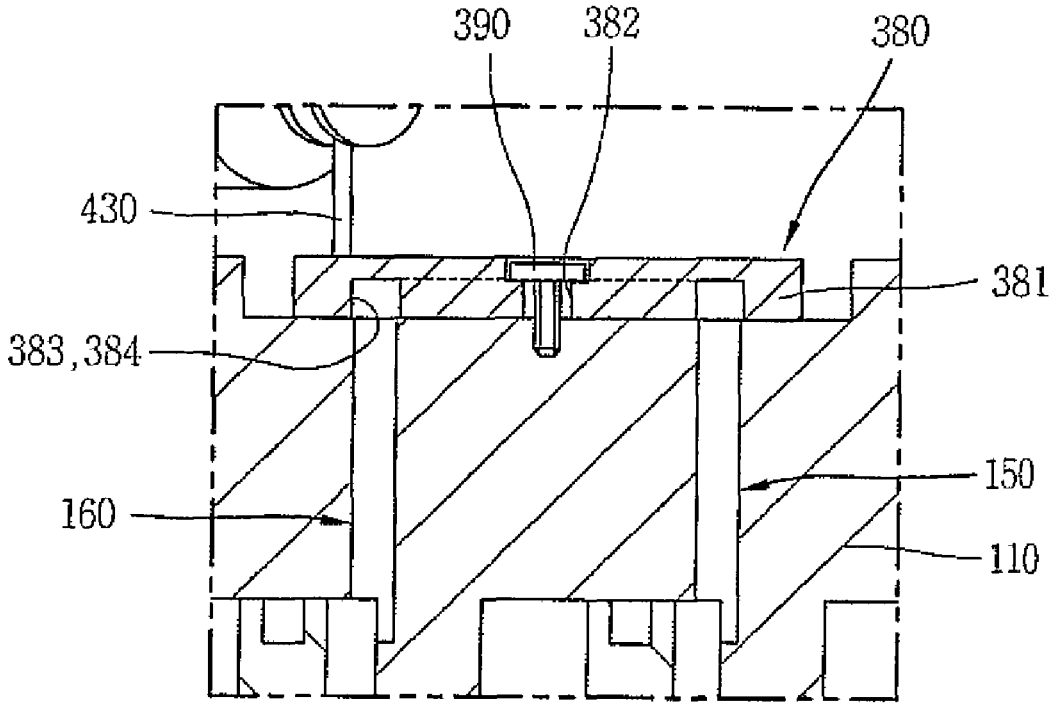
FIG. 11 is a cross-sectional view showing an assembled state of the capacity varying device of FIG. 10.

Still another embodiment of a capacity varying device for a scroll compressor according to an embodiment will be describe in detail with reference to FIGS. 10 and 11. This embodiment is the same as the previously discussed embodiment except for the rotating device, and thus, repetitive disclosure will be omitted.

As shown in FIGS. 10 and 11, the rotating device 300 may include a first disc 380 rotatably coupled to the fixed scroll 100 and having a connection passage that allows the low pressure passage 150 to be connected to the intermediate pressure passage 160, and that allows the low pressure passage 150 to be disconnected from the intermediate passage 160, and a separation preventing member 390 that supports the rotation of the first disc 380 and prevents separation of the first disc 380 from the installation groove 170.

The first disc 380 may include a circular body 381 having a particular thickness and external diameter, a connection passage formed in a lower surface of the circular body 381 so as to connect the low pressure passage 150 to the intermediate pressure passage 160, and an insertion hole 382 formed through the center of the circular body 381. The first disc 380 may be rotatably inserted in the installation groove 170 formed in an upper surface of the fixed scroll 100.

The separation preventing member 390 may be configured as a bolt which may be inserted in the insertion hole 382 of the first disc 380 to be coupled to the fixed scroll 100. The separation of the first disc 380 may be prevented by the bolt head, and the first disc 380 may rotate while being supported by the bolt. The connection passage may include a first connection groove 383 that connects a first hole 151 of the low pressure passage 150 to a first hole 161 of the intermediate pressure passage 160, and a second connection groove 384 that connects a second hole 152 of the low pressure passage 150 to a second hole 162 of the intermediate pressure passage 160.

A fixing pin K may be fixed to the upper surface of the fixed scroll 100, and an opening 385 may be formed through the first disc 380, and the fixing pin K may be located in the hole 385.

With such configuration, the first disc 380 may move within a preset range in cooperation with the operation of the operating device 400, such that the low pressure passage 150 and the intermediate pressure passage 160 may be connected or disconnected to/from each other via the first and second connection grooves 383 and 384, thereby varying a compression capacity.

As described above, according to the various embodiments disclosed herein, the disc or discs rotate in cooperation with the operation of the operating device 400 so as to connect or disconnect the low pressure passage 150 and the intermediate pressure passage 160. Hence, the intermediate pressure side and the suction pressure side formed by the fixed and orbiting scrolls 100 and 200 may communicate with each other or be blocked therefrom, to vary a compression capacity.

Figure 12:
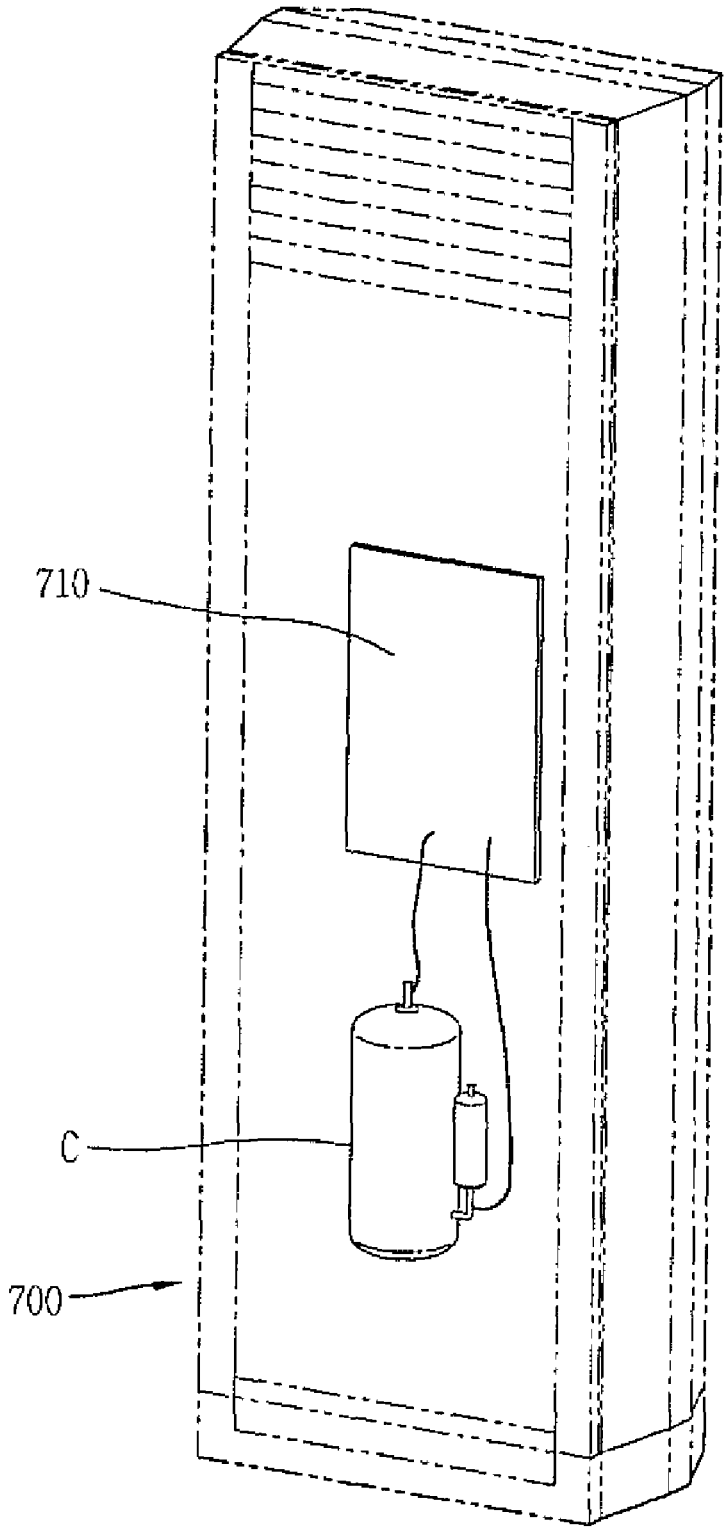
FIG. 12 is a schematic view of an exemplary air conditioner including a scroll compressor according to embodiments disclosed herein.
Figure 13:
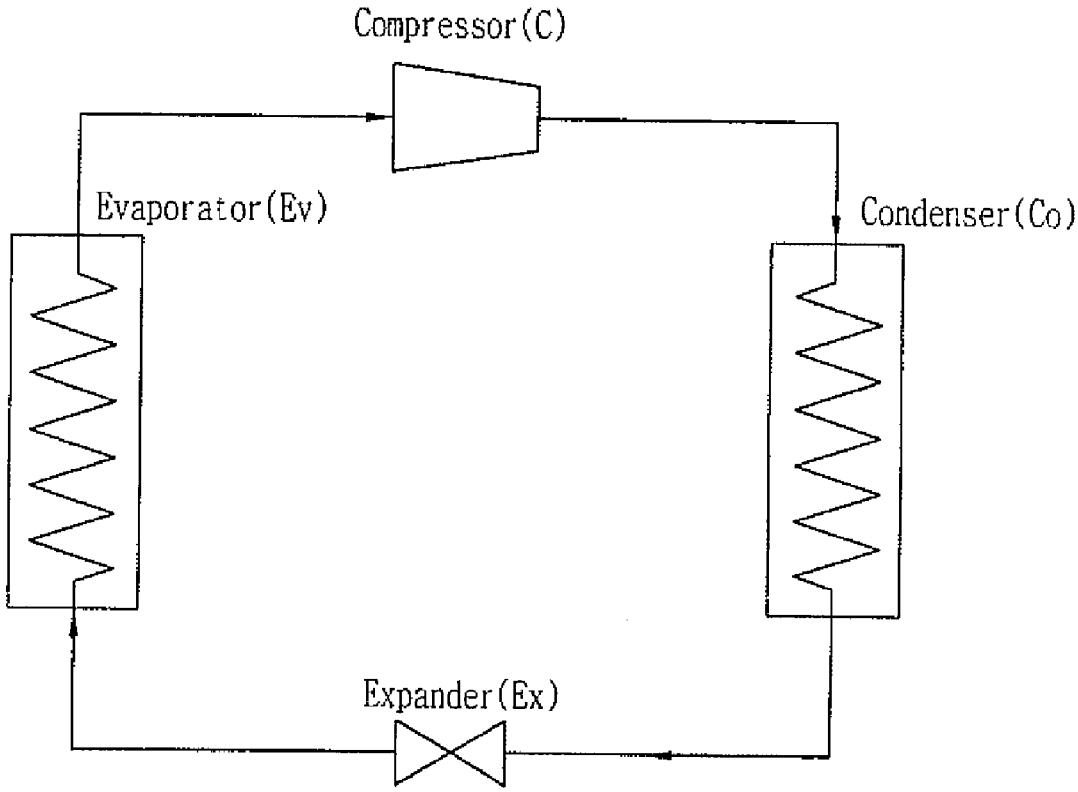
FIG. 13 is a schematic drawing of a refrigerating cycle of the air conditioner of FIG. 12.

The scroll compressor according to embodiments disclosed herein may be employed in an air conditioner, such as air conditioner 700 shown in FIG. 12 having a refrigerating cycle as shown in FIG. 13. In such an air conditioner 700, the compressor C may be connected to a main board 710 that controls overall operation of the air conditioner 700. Upon installing an air conditioner having a scroll compressor employing a capacity varying device in accordance with such various embodiments, the air conditioner may be driven in a power mode using approximately 100% of capacity in summer while being driven in a saving mode in which the compression capacity is decreased, so as to enhance an energy efficiency by saving approximately 25 to 33% of energy in the entire system as compared to an on/off type system.

Also, upon employing an inverter related method using an adjustable speed motor, the motor may rotate at low speed during a saving mode operation, whereby oil contained in a bottom of the casing is not sufficiently supplied to a compression part, which may cause problems in oil supply and device reliability. However, since the motor of the motor part rotates at constant speed in the disclosed embodiment, the oil supply and device reliability may be maintained.

In addition, according to the various embodiments disclosed herein, the compression capacity may be varied by the operation of the operating device 400 and the rotation of the disc or discs, which allows a simple and compact configuration and structure for varying the compression capacity.

Further, according to the various embodiments disclosed herein, the operating device 400 may pull or push the disc or discs to rotate them, and accordingly the low pressure passage 150 and the intermediate pressure passage 160 may communicate with each other or block from each other, resulting in a fast response to varying the compression capacity.

Embodiments disclosed herein provide a capacity varying device for a scroll compressor capable of varying a capacity for compressing gas and also reducing a size of a scroll compressor due to a compact capacity-varying structure. Further, embodiments disclosed herein provide a capacity varying device for a scroll compressor capable of providing a fast response upon varying a capacity.

Embodiments disclosed herein provide a capacity varying device for a scroll compressor that may include a fixed scroll and an orbiting scroll both located in a casing, a low pressure passage formed by an orbiting motion of the orbiting scroll and communicated with a suction side, an intermediate pressure passage formed by the orbiting motion of the orbiting scroll and communicated with an intermediate pressure side, a rotating unit or device rotatably coupled to the fixed scroll and having a connection passage therein, and an operating device mounted at the fixed scroll and configured to rotate the rotating unit such that the low pressure passage and the intermediate pressure passage are connected to each other or disconnected from each other via the connection passage of the rotating unit. A stopper may be provided to restrict the moving of the rotating unit.

The rotating unit may include a first disc having a circular body and provided with first and second low pressure communicating holes communicated with the low pressure passage and first and second intermediate pressure communicating holes communicated with the intermediate pressure passage, so as to be fixed to the fixed scroll, a second disc having a circular body and provided with first and second lower pressure communicating holes corresponding to the first and second low pressure communicating holes of the first disc and first and second intermediate pressure communicating holes corresponding to the first and second intermediate pressure communicating holes of the first disc, so as to be rotatably coupled to the first disc, a third disc having a circular body and provided in one surface of the circular body with a first connection groove formed to connect the first low pressure communicating hole of the second disc to the first intermediate pressure communicating hole of the second disc and a second connection groove formed to connect the second low pressure communicating hole of the second disc to the second intermediate pressure communicating hole of the second disc, so as to be fixedly coupled to the second disc and connected to the operating unit, and a separation preventing member coupled to the first disc for preventing the separation of the first and second discs.

The operating unit may include a solenoid configured to generate a linear reciprocating force, a fixing member configured to fix the solenoid to the upper surface of the fixed scroll, and a connection pin coupled to the rotating unit and connected to the solenoid.

In one embodiment, the disc or discs may be rotated in cooperation with the operating unit, so as to communicate the low pressure passage with the intermediate pressure passage or disconnect such passages from each other, thereby varying a compression capacity. Accordingly, the system operation may be controlled by varying such capacity according to, for example, hot summer, or early fall or spring, thus improving energy efficiency of a system.

Also, upon employing an inverter related method using an adjustable speed motor, the motor may rotate at low speed during a saving mode operation, whereby oil contained in a bottom of the casing may not be sufficiently supplied to a compression part, which may cause problems in oil supply and device reliability. However, since the motor of the motor part rotates at a constant speed in embodiments disclosed herein, the oil supply and device reliability may be maintained.

Since the capacity may be varied by the operation of the operating unit and the rotation of the disc or discs, a simple and compact configuration and structure for varying the compression capacity may be implemented, resulting in a decrease of the entire size of the compressor.

In addition, the operating unit pushes or pulls the disc or discs to rotate them, such that the low pressure passage is communicated with the intermediate pressure passage or disconnected therefrom, whereby the response to the varying of the compression capacity, namely, a mode conversion, may be quickly implemented.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A capacity varying apparatus for a scroll compressor, the capacity varying apparatus comprising:

a first disc configured to be fixed in an installation groove formed in an upper surface of a fixed scroll of the scroll compressor, wherein the first disc comprises at least one first low pressure communication hole and at least one first intermediate pressure communication hole formed therein;

a second disc rotatably coupled to the first disc, wherein the second disc comprises at least one second low pressure communication hole and at least one second intermediate pressure communication hole formed therein; and a stopper that engages the first disc and the second disc to restrict movement of the second disc relative to the first disc, wherein the stopper comprises:

a pin that extends upward from the first disc toward the second disc; and a protrusion that protrudes outward from an outer circumferential surface of the second disc, the protrusion having an elongated slot formed therein in which the pin is received, wherein rotation of the second disc relative to the first disc is restricted by engagement of the pin in the slot, wherein the at least one first low pressure communication hole, at least one first intermediate pressure communication hole, at least one second low pressure communication hole and at least one second intermediate pressure communication hole selectively provide for communication between at least one low pressure passage and at least one intermediate pressure passage formed in a body of the fixed scroll based on a position of the second disc, wherein the at least one low pressure passage communicates with a low pressure area of the scroll compressor; and the at least one intermediate pressure passage communicates with an intermediate pressure area of a plurality of compression pockets of the scroll compressor.

2. The capacity varying apparatus of claim 1, further comprising a drive device configured to rotate the second disc.

3. The capacity varying apparatus of claim 2, wherein the drive device comprises a solenoid.

4. The capacity varying apparatus of claim 1, further comprising a sealing member provided for each of the at least one first low pressure communication hole and at least one first intermediate pressure communication hole.

5. The capacity varying apparatus of claim 1, wherein a lower end of each of the at least one low pressure passage and the at least one intermediate pressure passage is angled to enlarge a pressure contact portion.

6. The capacity varying apparatus of claim 1, wherein each of the at least one low pressure passage and the at least one intermediate pressure passage comprises two passages spaced apart by a predetermined distance.

7. A scroll compressor comprising the capacity varying device of claim 1.

8. The capacity varying apparatus of claim 1, further comprising a third disc coupled to the second disc such that the second disc is positioned between the first disc and the third disc, wherein the third disc comprises:

at least one third low pressure communication hole and at least one third intermediate pressure communication hole formed therein;

at least one connection groove that connects the at least one second low pressure communication hole and the at least one second intermediate pressure communication hole formed in the second disc so as to selectively provide for communication of the at least one first low pressure communication hole, at least one second low pressure communication hole, at least one connection groove, at least one second intermediate pressure communication hole and at least one first intermediate pressure communication hole.

9. The capacity varying apparatus of claim 8, wherein the first disc is fixed to the upper surface of the fixed scroll and remains stationary with respect to the fixed scroll, the second disc is rotatably coupled to an upper surface of the first disc and rotates with relative to the first disc, and the third disc is fixed to an upper surface of the second disc such that the third disc rotates together with the second disc.

* * * * *